US005263271A

United States Patent [19]

Cox et al.

[11] Patent Number: 5,263,271

[45] Date of Patent: Nov. 23, 1993

[54] ANNUMCIATOR WITH IMPROVED DEADFRONT EFFECT AND IMPROVE LIGHT DISTRIBUTION UNIFORMITY

[75] Inventors: Ronald G. Cox, Cedarville; Marvin D. Karg, Freeport, both of Ill.

[73] Assignee: Honeywell Inc., Minneapolis, Minn.

[21] Appl. No.: 724,025

[22] Filed: Jul. 1, 1991

[51] Int. Cl.[5] ..... G09F 13/04

[52] U.S. Cl. ..... 40/564

[58] Field of Search ..... 40/564, 577, 580, 442, 40/443, 541, 900; 359/549, 599, 601, 609, 602, 855; 362/26, 27; 385/901, 133; 340/815.07, 815.03, 815.15, 957, 759

[56] References Cited

U.S. PATENT DOCUMENTS

| | | | |
|---|---|---|---|
| 2,821,800 | 2/1958 | Hardesty | 362/26 |
| 2,998,597 | 8/1961 | Edwards | 362/27 |
| 3,106,032 | 10/1963 | Morgan | 40/900 |
| 3,561,145 | 2/1971 | Shotwell . | |
| 3,793,514 | 2/1974 | Curl . | |
| 3,799,647 | 3/1974 | Luft . | |
| 3,800,135 | 3/1974 | Ramsey . | |
| 4,012,632 | 3/1977 | Stone | 40/541 |
| 4,126,855 | 11/1978 | Alms et al. | 40/564 |
| 4,288,672 | 9/1981 | Puccini . | |
| 4,376,879 | 3/1983 | Nagata et al. . | |
| 4,532,395 | 7/1985 | Zukowski . | |
| 4,535,396 | 8/1985 | Guthrie | 362/27 |
| 4,798,426 | 1/1989 | Malcolm et al. . | |
| 4,812,831 | 3/1989 | Laier . | |
| 4,851,624 | 7/1989 | Chestnut et al. . | |
| 4,903,171 | 2/1990 | Livezey et al. | 362/26 |
| 5,144,328 | 9/1992 | Blake et al. | 40/443 |

*Primary Examiner*—Kenneth J. Dorner
*Assistant Examiner*—Cassandra Hope Davis
*Attorney, Agent, or Firm*—William D. Lanyi

[57] ABSTRACT

An annunciator apparatus has a light directing device that efficiently causes light to pass from a light source, such as a lamp, toward a generally flat surface of the light directing device in an efficient manner. The light pipe of the annunciator incorporates parabolic rear surfaces that are reflective. In addition, discs of partially reflective and partially transmissive material are disposed directly between a light source and the preselected plane toward which light is directed perpendicularly. The annunciator comprises an indicia plate which incorporates layers to accomplish the desired effect of having a reduced reflection characteristic. Indicia are represented on front and back surfaces of a substrate and aligned with each other to define a "pinhole" effect that significantly reduces light reflected back from the light directing device toward the viewer.

19 Claims, 3 Drawing Sheets

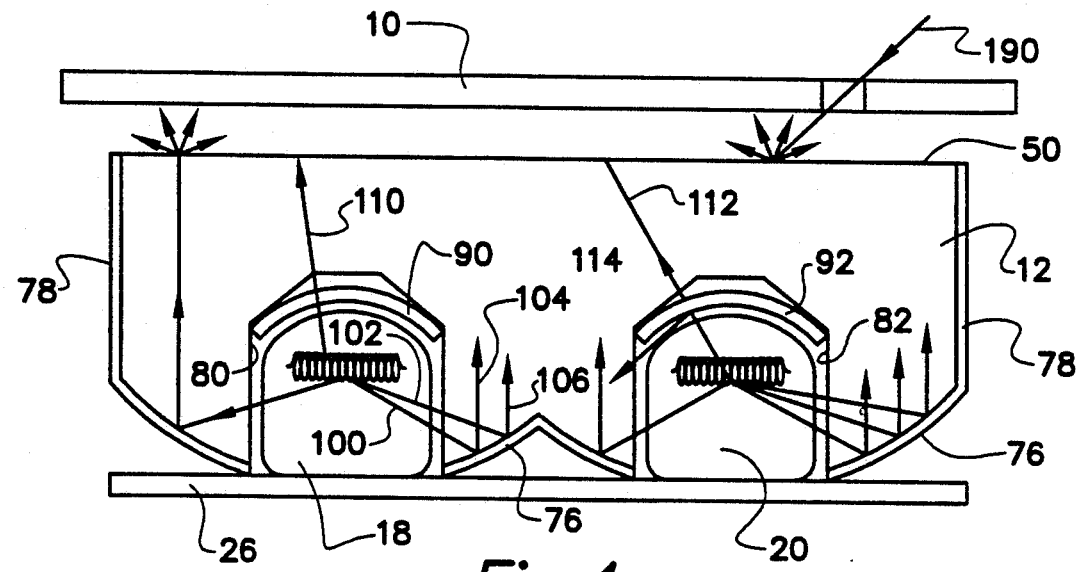
Fig. 4
Fig. 5
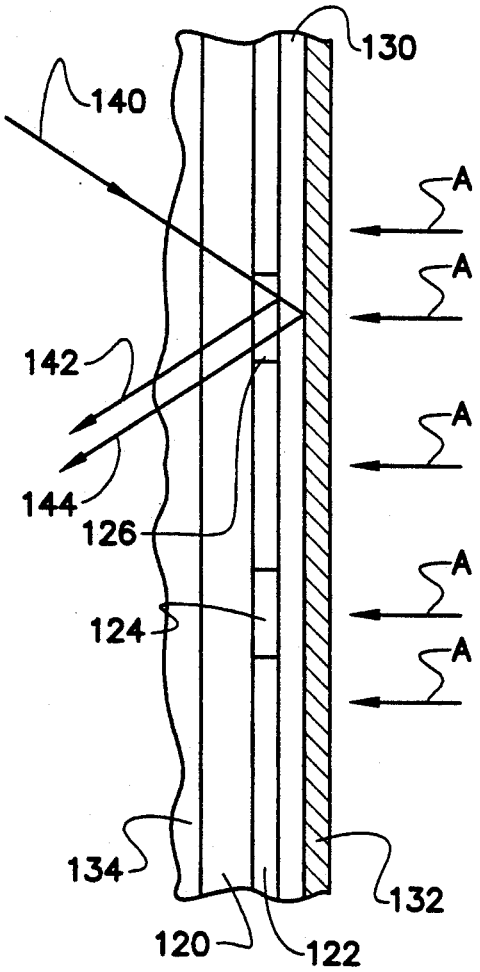
Fig. 6
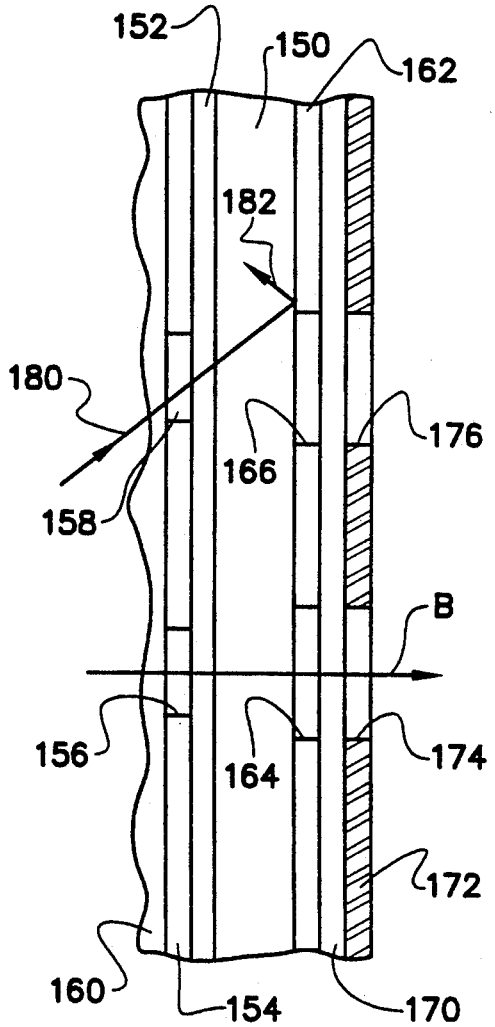

ANNUMCIATOR WITH IMPROVED DEADFRONT EFFECT AND IMPROVE LIGHT DISTRIBUTION UNIFORMITY

BACKGROUND OF THE INVENTION

1. Field of the Invention

The present invention is generally related to a panel annunciator mechanism and, more particularly, to an annunciator device which improves the efficiency of an annunciator and reduces reflective output from the annunciator when it is de-energized.

2. Description of the Prior Art

Many types of annunciators are known to those skilled in the art. It is common to use a light source in combination with a reflector to direct light toward a plate or membrane which has various indicia for the purpose of causing the light to pass through or around the indicia.

U.S. Pat. No. 4,288,672, which issued to Puccini on Sep. 8, 1981, discloses an illuminated keyboard apparatus which is useful in vehicle control panels. The illumination of key indicia is desired to facilitate identification and actuation of selected keys. The apparatus includes a housing for mounting key switches in a selected array with a frame disposed in the housing having key receiving apertures extending through a top of the frame. The frame is composed of light transmitting material and is arranged to transmit light from a light source mounted below the circuit board into and through the key identification indicia formed in a label disposed from the top of the frame.

U.S. Pat. No. 4,798,426, which issued to Malcolm et al on Jan. 17, 1989, describes a holographic optical element for use in an instrument panel display. The element is applied over existing aircraft panels and instruments so as to display an image which is reflected from a source located off the panel. The image is reflected only to an area at which the viewer may observe the image and is not directed to other areas so as to prevent unwanted reflection and glare within an aircraft cockpit.

U.S. Pat. No. 4,812,831, which issued to Laier on Mar. 14, 1989, discloses a key switch with a controllable illumination. An illuminated membrane keyboard includes a light beam matrix which, when broken by the shadow of a stylus, operates logic to turn on illumination for a preset time rendering a normally dead front appearing keyboard visible. This feature conserves energy that is required to power the illumination, lengthens the life of the illuminating source and limits access to the keyboard.

U.S. Pat. No. 4,851,624, which issued to Chestnut et al on Jul. 25, 1989, discloses a control assembly which has a panel illumination apparatus. The control assembly provides types of control elements such as switches and potentiometers carried in a housing. The housing includes an applique which has openings through which manual operating levers extend to operate the control elements. The applique includes labeling to indicate the functions being controlled. Lights are carried in the housing with the light emanating therefrom being directed to the openings for sharp illumination at the openings, in the levers and the labeling.

U.S. Pat. No. 3,793,514, which issued to Curl on Feb. 19, 1974, describes a panel lamp assembly for illuminating an instrument panel. It facilitates replacement of lamps and increases the amount of useful light from them, including a transparent housing located in a panel recess, a lamp assembly in the housing and a cap that can be screwed into the housing to hold the lamp assembly in place.

U.S. Pat. No. 3,799,647, which issued to Luft on Mar. 26, 1974, discloses a constant visibility electro-optic display. It has two coincident modes of operation, reflective and emissive. A partially silvered mirror reflects external ambient light and also passes light emitted from an internal source of back-lighting. The combined effects of the reflected and emitted light cause the contrast, and therefore the visibility of the display to be relatively constant even though the ambient light conditions may vary.

U.S. Pat. No. 3,800,135, which issued to Ramsey on Mar. 26, 1974, describes a fiber optic display panel illuminator. This device can be used in association with an automobile instrument panel and is formed with a reflective coded concave depression in an area where illumination of a legend or other device is required. The depression is slotted to afford insertion of a fiber optic ribbon which extends through the depression. The ribbon is remotely energized by a lamp to illuminate the depression. A clear plastic envelope for supporting the ribbon within the depression in assembled to the ribbon and the assembly is inserted into the slot from the rear of the instrument panel such that the slot holds the supporting envelope in place.

U.S. Pat. No. 4,532,395, which issued to Zukowski on Jul. 30, 1985, describes an electroluminescent flexible touch switch panel. The panel has a deformable membrane carrying a switch closure member and is provided with an overlying flexible electroluminescent laminated member providing light to the entire switch panel or selected areas thereof including lighting of keytop indicia on the flexible touch switches.

U.S. Pat. No. 4,376,879, which issued to Nagata et al on Mar. 15, 1983, describes a buttonless push switch board. It includes a plurality of push switches which comprises an insulator plate having a plurality of penetrating holes, a transparent flexible cover sheet overlying the main surface of the insulator sheet and identification marks printed thereon to indicate the position and functions of the switches. A transparent block is disposed in each hole of the insulator plate and is urged towards the cove plate by elastic members supported thereon. Each elastic member is cup shaped and has a movable contact corresponding to a pair of fixed contacts on the printed circuit plate. A lamp or a light emitting diode is disposed in each hole of the insulator plate and is mounted o the printed circuit.

U.S. Pat. No. 3,561,145, which issued to Shotwell on Feb. 9, 1971, describes a light distributing lens system for illuminating a display. It employs a tapered three dimensional wedge shaped panel member of substantially transparent material. It also employs a light source encased in a recess in the thicker base portion of the tapered wedge shaped panel member and an opaque frame intimately supporting the periphery of the tapered wedge-shaped panel member in a manner to obscure the light source from external view, but to permit the projection of light rays from the light source onto the display directly as well as indirectly through internal reflection from the entire first planar surface of the tapered wedge-shaped panel member.

SUMMARY OF THE INVENTION

The present invention solves several problems relating to annunciators known to those skilled in the art. First, it permits operation of the annunciator at two different voltage levels with a prescribed relationship between the brightness at the lower voltage level and the brightness at the higher voltage level. Furthermore, the present invention significantly minimizes the glare of a bright spot which is normally caused by the use of a light source such as the lamp in a backlighting arrangement. In addition, the present invention significantly reduces the self lighting characteristic which often causes annunciators to be readable even when they are de-energized as a result of reflected light originating from a point in front of the annunciator panel.

In a preferred embodiment of the present invention, the annunciator comprises a means for defining a light source position. In a most preferred embodiment of the present invention, this defining means includes a cavity formed in the rear portion of a light directing member. The annunciator of the present invention also comprises a means for directing light in a direction that is generally perpendicular to a preselected plane. The light directing means has a reflecting surface with the light source position being disposed between the preselected plane and the reflective surface. The reflective surface is curved in a preferred embodiment of the present invention. The present invention also comprises a means, disposed between the light source position and the preselected plane, for partially directing light toward the reflective surface and partially transmitting light toward the preselected plane In a preferred embodiment of the present invention, the annunciator comprises a symbol plate which, in turn, comprises a generally transparent substrate having first and second sides. A first legend layer is disposed on the first side of the substrate, wherein the first legend layer defines a symbol. A second legend layer is disposed on the second side of the substrate and defines a second symbol. The first and second symbols are aligned with each other with the substrate disposed therebetween. A reflective layer is disposed on the second side of the substrate with a second legend layer being disposed between the substrate and the reflective layer. A preferred embodiment of the present invention further comprises a color layer disposed between the second legend layer and the reflective layer.

BRIEF DESCRIPTION OF THE DRAWING

The present invention will be more fully understood from a reading of the Description of the Preferred Embodiment in conjunction with the drawing, in which:

FIG. 4 illustrates a schematic representation of the light directing means of the present invention to show the operation of its internal portions;

FIG. 5 represents a symbol plate made in accordance with known concepts; and

FIG. 6 illustrates a symbol plate made in accordance with the present invention.

DESCRIPTION OF THE PREFERRED EMBODIMENT

Figure 1:
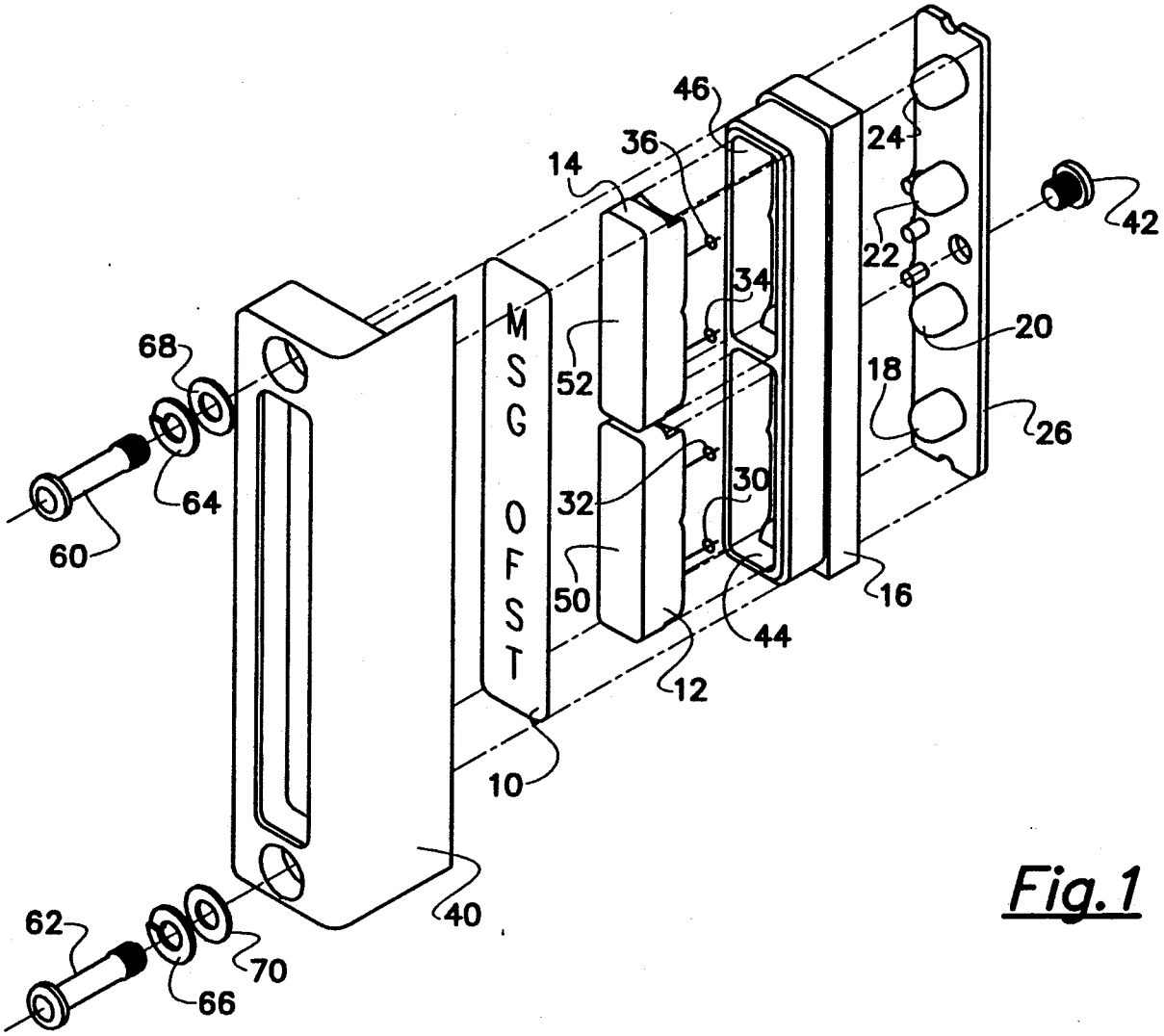
FIG. 1 illustrates an exploded view of a panel annunciator incorporating the concepts of the present invention.

Throughout the description of the preferred embodiment, like components will be identified by like reference numerals.

In FIG. 1, an indicia plate 10 is shown disposed in front of two light directing devices, 12 and 14, which operate as light pipes in the present invention. The light directing means are disposed in a base member 16 which, in turn, is shaped to receive a plurality of lamps, 18, 20, 22, and 24, into openings in the back portion (not shown in FIG. 1) of the base 16. The lamps are mounted on a lamp board 26. Also shown in FIG. 1 is a plurality of small discs, 30, 32, 34 and 36, which are disposed in openings in the back portions of the light directing means, 12 and 14, and serve as partially reflective and partially transmissive devices. These devices will be described in greater detail below in conjunction with FIG. 3.

The components described above are assembled as illustrated in FIG. 1 and associated with a housing member 40 for mounting to a switch panel assembly. The lamp board 26 is attached to the base 16 with screw 42 and the light directing means, 12 and 14, are inserted into the generally rectangular openings, 44 and 46, in the front portion of the base. The small discs, 30–36, are disposed in openings which ar formed in the back portion of the light directing means. The indicia plate 10, which is a screened substrate that will be described in greater detail below, is disposed in front of the flat surfaces, 50 and 52, of the light directing means. After assembly, the housing 40 with all of the attached components shown in FIG. 1 is connected to a switch panel device with the screws, 60 and 62, the lock washers 64 and 66 and the washers 68 and 70.

With continued reference to FIG. 1, it can be seen that when the lamps are energized, light will be directed by the light directing means, 12 and 14, in a direction generally perpendicular to a pre-selected plane. In FIG. 1, that preselected plane is generally parallel to the front faces, 50 and 52, of the light directing means and also to the indicia plate 10. The lamps, 18–24, are shaped to be received into openings in the back portion of the light directing means. Those openings will be described in greater detail below in conjunction with FIG. 3, but it should be understood that those openings provide a means for defining a light source position into each of which one of the lamps can be selectively disposed.

Figure 2:
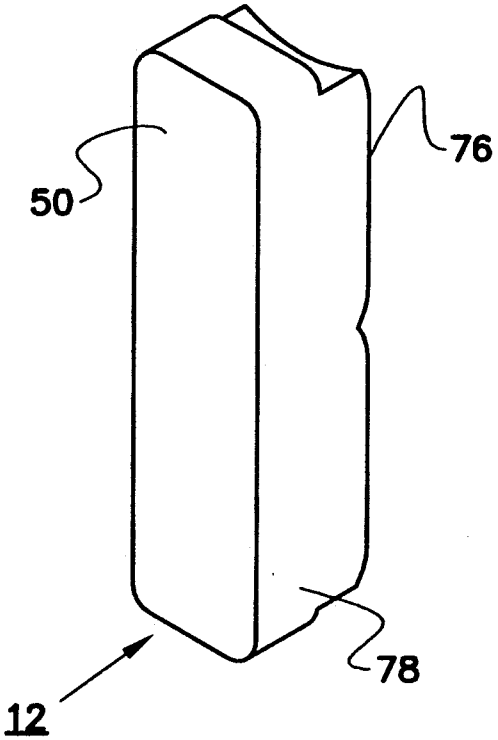
FIG. 2 illustrates the basic configuration of a light directing means of the present invention.

FIG. 2 shows the lower light directing means 12 of the present invention. It should be understood that the operation of the specific light directing means 12 in association with specific light sources is generally identical to and representative of the operation of the other light directing means with its associated light sources. For simplicity, only light directing means 12 will be described below. The light directing means comprises a back portion 76 and a front face 50. The back portion has two openings formed therein (not shown in FIG. 2) which operate as mean for defining light positions. The remaining portion of the back surface 76 is coated with a light reflective coating, such as white paint. The front face 50 is generally flat and parallel to the preselected plane described above. The curved back surfaces of the light directing means 12 are generally shaped in a parabolic configuration to reflect light from a light source position in a direction generally perpendicular to the preselected plane described above and to the front face 50 of the light directing means 12. The side surfaces 78, which are also coated with a reflective coating, are shaped to be received in the generally rectangular opening 4 of the base 16, as illustrated in FIG. 1.

Figure 3:
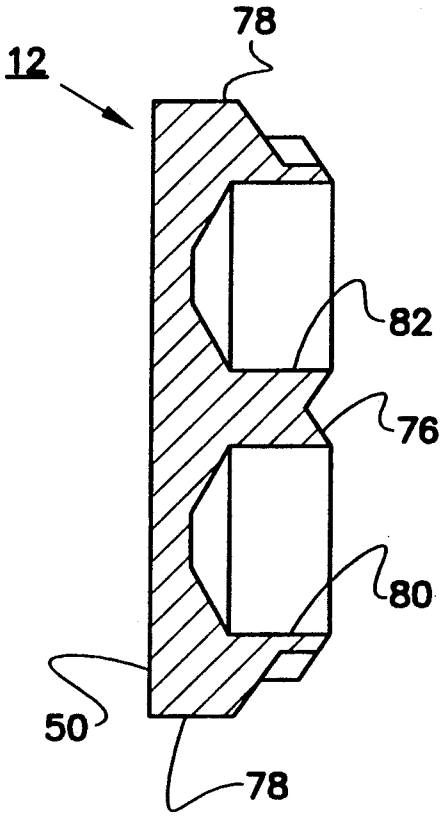
FIG. 3 illustrates a sectional view of the light directing means of FIG. 2 to show the means for defining a light source position.

FIG. 3 illustrates a sectional view of the light directing means 12. As can be seen, the front face 50 is generally flat and the back surface 76 is shaped in a configuration to form two individual parabolic surfaces. In the back portion of the light directing means 12, two openings, 80 and 82, are formed. These openings are shaped to receive a light source therein. With reference to FIG. 1 and FIG. 3, it should be understood that the openings, 80 and 82, are shaped to receive preselected ones of the plurality of lamps, 18–24, that are attached to the lamp base 26. The openings, 80 and 82, serve to provide a means for defining a light source position in a preferred embodiment of the present invention. As will be described in greater detail below, the defining means receive a lamp therein and cooperate with the remaining portions of the light directing means 12 to direct light in a direction generally perpendicular to the front face 50 and toward the left in FIG. 3 when a lamp is disposed in the opening and energized to emit light.

FIG. 4 shows a schematic representation of the light directing means 12. In FIG. 4, two lamps, 18 and 20, are shown disposed in the two openings, 80 and 82, respectively. The lamps are shown schematically emitting light as represented by the numerous arrows in FIG. 4. Also schematically shown in FIG. 4 is the indicia plate 10.

With reference to opening 80 in FIG. 4, it can be seen that this opening serves to provide a means for defining a light source position. It performs this function by being shaped to receive a light source, or lamp 18, within its opening. The back surface 76 of the light directing means 12 is shaped in a curved manner as illustrated. In a preferred embodiment of the present invention, the back surface 76 is shaped in a parabolic configuration. In the embodiment shown in FIG. 4, each of the two means for defining a light source position is provided with an individual parabolic surface associated with it.

With continued reference to FIG. 4, it can be seen that some of the light emitted by lamp 18 is directed back toward the rear surface 76. This light is represented by arrows 100 and 102. When that light strikes the parabolic reflective surface 76, it is reflected in a direction generally perpendicular to a preselected plane. In a preferred embodiment of the present invention, that preselected plane is generally parallel to the front face 50 of the light directing means 12 and also parallel to the indicia plate 10. This reflection by the parabolic surface 76 directs a majority of the light which is emanating from the light source in a rearward direction back toward the front portion of the light directing means 12. In essence, the back surface 76 operates as a mirror to efficiently reflect light in a forward direction as represented by arrows 104 and 106.

With continued reference to FIG. 4, it can be seen that some light emitted by the lamp 18 is directed toward the front face 50 of the light directing means 12. This light is represented by arrows 110 and 112. This light passes through the associated disc, 90 or 92. The discs are partially reflective and partially transmissive to light. Although the discs can be selected to have a light transmission characteristic that is most suitable for any particular application, in one alternative embodiment of the present invention, the discs, such as disc 90, are between 35 and 40 percent transmissive and between 60 and 65 percent reflective. As represented by arrow 112, it can be seen that a portion of the light emanating from the lamp filament passes through the disc, whereas a portion of the light is reflected back toward the rear surface 76. This reflected portion is schematically represented by arrow 114. The discs serve an important function in the present invention. They partially block the light that emanates directly from the filament of the lamp 18 in a direction toward the front face 50. This serves to reduce the glare or bright spot that would otherwise be evident through the front face 50 and indicia plate 10 when viewed from the front portion of the annunciator. Typically, the portion of the indicia plate 10 directly in front of the lamp would exhibit a bright spot. By being disposed directly between the lamp 18 and the indicia plate 10, the disc 90 diffuses a portion of the light emanating from the lamp. It is important that the disc 90 does not block all of the light emanating directly toward the front surface 50 from the lamp 18 because that would create an opposite, but equally deleterious, result of a dark spot immediately above the lamp. The light reflected by the disc 90 back toward the parabolic back surface 76 is reflected by that curved surface 76 in a direction generally perpendicular to the preselected plane described above. Therefore, while diffusing a portion of the light passing from the filament of the lamp in a direction toward the front surface 50, the disc 90 preserves that light which is prevented from passing directly toward the front surface by reflecting a portion of the light back toward the parabolic surface to be reflected in the appropriate direction. Therefore, it should be understood that the discs prevent the bright spot while minimizing their negative effect on the efficiency of the annunciator's ability to convert electrical power to light. The surface of the light directing means 12 in FIG. 4, identified by reference numerals 76 and 78, represents a coated surface that is coated with a reflective paint or other appropriate coating material. In a preferred embodiment of the present invention, white paint, such as white polyurethane, is used to provide the reflective coating for surfaces 76 and 78.

FIG. 4 also illustrates the indicia plate 10 and its relative position in relation to the light directing means 12. The structure of the indicia plate 10 in FIG. 4 is highly simplified and shown only in a schematic manner. It should be understood that the indicia plate 10 is more complex than shown in FIG. 4. The particular structure of the indicia plate 10 will be described below in comparison to plates known in the prior art.

FIG. 5 illustrates an indicia plate, or screened substrate, of the type which is generally known to those skilled in the art. It comprises a substrate material 120 which is generally about 0.010 inches thick. On a back surface of the substrate 120, a black legend layer 122 is provided in which indicia are painted onto the back surface. For example, the darkened portions of the black legend layer 122 represent parts of the surface which do not contain the indicia, such as a numeral or a letter. In contrast, the uncoated portions of the black legend layer 122, as identified by reference numerals 124 and 126, represent portions of the surface at which the indicia lie. In other words, the areas around the indicia are blackened while the indicia themselves are uncoated. This permits light from the back portion of the indicia plate to pass through the uncoated portions, 124 and 126, and cause light to pass through the substrate in the shape of the indicia. Light passing in the direction indicated by arrows A in FIG. 5 either passes through the unblackened portions, 124 and 126, or are blocked by the blackened portions of the black legend layer 122. Behind the black legend layer 122 is a neutral density layer 130. Typically, the neutral density layer 130 is used to mask the indicia from being readily apparent when the light source associated with the indicia plate is de-energized. I other words, when light passes in a direction from left to right in FIG. 5, in the opposite direction to arrows A, it could possibly pass through the openings, 124 and 126, and be reflected back toward the viewer on the left side of the figure. This is undesirable because it could mislead the viewer into believing that the annunciator had been energized when, in reality, it has not. This problem exists in virtually all annunciators and is typically caused by sunlight or other light from the front side of the panel being reflected back toward the viewer by the indicia plate and its associated coatings. Arrows 140 and 142 indicate the directions in which light can pas through the openings in the black legend layer 122. Arrows 140 and 142 represent the range in angular direction of these potential light beams. Typically, the neutral density layer 130 is chosen to generally resemble the color of the blackened portions of the black legend layer 122 but of a light transmissive quality. In annunciators of this type, a neutral density layer 130 is usually made of some generally clear material with pigment added to form a generally grayish appearance. The neutral density layer masks the characters in the indicia layer by making the background and the character appear to be the same color to the viewer. As will be described in greater detail below in conjunction with FIG. 6, the present invention utilizes neutral density layers to accomplish these and more important functions.

On the back surface of the indicia plate in FIG. 5, a color layer 132 is provided. The color layer is used to provide color to the indicia when light passes through it as indicated by arrows A. In other words, the light passing through the color layer 132 appears in the openings, 124 and 126, in the color which is determined by the color layer 132. A red color layer will cause the indicia to appear as red with a black background which is provided by the darkened portions of the black legend layer 122.

The front surface of the substrate 120 is provided with a matte surface. The function of the matte surface is to diffuse light which emanates from the front portion of the panel, such as from sunlight or artificial light in the cabin of an aircraft, and prevent deleterious reflections from the front surface of the substrate. The matte surface is identified by reference numeral 134 in FIG. 5.

Some of the serious difficulties associated with indicia panels known to those skilled in the art can be recognized by continued reference to FIG. 5. Arrows 140 and 142 represent the paths in which light can enter the annunciator from a point in front of the annunciator panel. For example, light can enter from the left side of FIG. 5, pass through openings 124 and 126 and enter the region within the light pipe or light source behind the indicia plate. This light can be sunlight or external lights located in the cabin of an aircraft or an automobile. In other words, the light represented by the arrows 140 comes from a source proximate the viewer at the front side of the annunciator. That light passes in the direction from left to right in FIG. 5 and can pass through the indicia plate into the region behind the plate. If light passes through the indicia plate from a point in front of the plate, at the left side of FIG. 5, and enters the region where the light source is located behind the indicia plate, that light can easily be reflected back from the light source through the openings, 124 and 126, toward the viewer in front of the panel. Therefore, even though the light source is de-energized, light emanating from the front side of the panel can pass through the indicia plate into the region where the light source is located and be reflected back towards the viewer to give a false and misleading indication that the light source is energized. As represented by arrows 140 and 142 in FIG. 5, light can enter the region behind the indicia plate through a wide range of angles and be reflected back toward the viewer. This is one of the problems addressed by the present invention.

FIG. 6 represents a cross sectional view of the indicia plate 10 that is illustrated in FIGS. 1 and 4. It comprises a substrate 150 which is thicker than the substrate normally used for the indicia plate. As an example, the substrate 150 in FIG. 6 is approximately 0.02 inches thick, whereas substrate 120 in FIG. 5 is usually about 0.01 inches thick. The precise thickness of the substrate 150 depends on the particular application and the requirements in that application. On the front surface of the substrate 150, a neutral density layer 152 is provided. It should be understood that the neutral layer 130 in FIG. 5 is disposed on the back surface of the substrate 120. The presence of the neutral density layer 152 on the front side of the substrate 150 performs two important functions in the present invention. First, as in annunciators made in accordance with the prior art, the neutral density layer 152 masks the characters by making the background and the character appears to the eye to be the same color. However, the neutral density layer 152 on the front side of the substrate 150 performs an even more important function in the present invention by attenuating the brightness of light as it passes through the indicia plate from left to right in FIG. 6 at an early point in the passage of light through the plate. The neutral density layer 152 is placed as close to the front surface of the indicia plate as possible so that the light passing through the neutral density layer is attenuated before it reaches the surfaces that could reflect the light. In addition, the neutral density layer and the black background are located at nearly the same level to make them as visually compatible as possible. Light passing into the substrate 150 in a direction from left to right in FIG. 6 has already passed through the neutral density layer 152 and therefore the light which could otherwise reflect back and forth within the substrate 150 is reduced. It has been determined that the reduced light passing into the substrate from left to right serves to minimize the glow that could otherwise occur as a result of light reflecting back and forth within the substrate material. In front of the neutral density layer 152, a black legend layer 154 is disposed with blackened portions defining openings, such as those represented by reference numerals 156 and 158. As described above, the openings are places on the substrate surface which are not blackened by the black legend layer. These openings are positions on the surface which combine to define the shape of the indicia, such as a numeric or alphabetic character. With reference to FIG. 1, the portions of the surface of the indicia plate 10 that contain the characters "MSG OFST" would be the undarkened portions of the surface while the remaining area on the front surface of the indicia plate 10 would be blackened. The appearance of the indicia has two openings, 156 and 158 in FIG. 6, because of the sectional characteristic of FIG. 6. A clear matte overspray 160 is provided o the front surface of the black legend layer 154.

With continued reference to FIG. 6, a black background surface 162 is disposed on the back surface of the substrate 150. The black background surface is very similar in appearance to the black legend layer 154 on the front surface and, in a preferred embodiment of the present invention, represents the same indicia which is represented on the front surface by the black legend layer 154. However, the indicia in layer 162 is larger than the indicia in layer 154. In other words, although both of these blackened layers may represent the alphabet character "A", the "A" on the front surface in layer 154 comprises narrower or thinner lines than the letter "A" on the back surface. Otherwise, the two indicia are aligned with each other with the substrate 150 being disposed between them. Openings 164 and 166 represent the openings in the black background layer which, in turn, represent the thicker version of the indicia represented by openings 156 and 158. With reference to FIG. 6, this thickened version is illustrated by the larger dimensions of openings 164 and 166 in layer 162 compared to the dimensions of openings 156 and 158 in layer 154. Behind the black background indicia layer 162, a color layer 170 is provided. As will be described below, the color layer 170 operates in a manner that is generally similar to the color layer 132 in FIG. 4. Behind the color layer 170, a white legend background 172 is provided. As can be seen in FIG. 6, the white legend background layer 172 is provided with openings 174 and 176 which are generally aligned with the openings 164 and 166 in the black background layer 162.

The aligned association of opening 158 and opening 166 or, alternatively, opening 156 and opening 164, create a "pinhole" effect that provides a significant benefit in reducing the false indication that is normally caused by light emitted from a source on the front side of the annunciator. This problem relates to the description above in conjunction with FIG. 5 and arrows 140 and 142. As represented by arrows 180 and 182 in FIG. 6, light passing through the indicia plate from left to right is limited to a much smaller range of angles than the light passing through the indicia plate of FIG. 5. This can be seen by comparing the relatively small range of angles identified between arrows 180 and 182 to the larger range of angles identified between arrows 140 and 142. This results from the fact that light must pass through openings 158 and 166 to successfully travel from a point in front of the indicia plate to the area near the light source behind the indicia plate. This restriction is further enhanced by the use of a thicker substrate 150 then is normally used. It should also be realized that light passing through opening 158, but not through opening 166, will reflect back and forth within the substrate and most probably be absorbed by the black non-reflective coatings on each side of the substrate surface. Therefore, sunlight emitted from the front side of the annunciator will not be reflected back through openings in the front side of the substrate 150 unless the light emanates in a direction virtually perpendicular to the indicia plate. In other words, unless the light passes in a direction, as indicated by arrow B in FIG. 6, which is aligned with the "pinhole" formed by the openings in the black legend layer 154 and the black background layer 162, it will not pass into the light directing means 12 and be reflected back toward the viewer. By absorbing a large percentage of light emitted from the front side of the panel, the present invention virtually eliminates the inadvertent indications that could otherwise be caused by reflected light passing back through the indicia plate toward the viewer after having originated from the front side of the indicia plate proximate the viewer or from behind the viewer. By aligning the openings, such as openings 158 with 166 or 156 with 164, the present invention creates the pinhole effect that traps a vast majority of undesirable light within the substrate 150 and does not permit it to be reflected back through the indicia plate toward the viewer and potentially represent a false and misleading indication of energization when such energization has not occurred.

The annunciator of the present invention is particularly intended for use as a "deadfront" or hidden legend in bright sunlight with the lamps de-energized. Furthermore, the present invention provides an annunciator which is sunlight readable with the lamps energized. These characteristics are provided while also providing a uniform brightness across the entire legend or display screen represented by the indicia plate 10. The present invention provides two important characteristics which improve the operation of annunciators. First, a preferred embodiment of the present invention provides a light pipe system, or a light directing means, for directing uniform light distribution in the direction of a preselected plane. The light directing means 12 and 14 of the present invention also increases the brightness gain ratio from the specified low voltage brightness to the high voltage brightness. This particular requirement relates to the fact that some annunciator applications require the associated lamps to be energized at two specific voltage values. In bright sunlight, a higher voltage is applied to the lamp to provide a brighter light output. In darkness, a lower voltage is provided to the lamp to prevent the operator from being distracted by signals emanating from the indicia plate. In other words, at night the low voltage is applied to the lamps and during daylight hours the higher voltage is applied. The present invention also provides a particularly effective screened substrate for use as the indicia plate 10. It provides numerous coatings, or layers, which cooperate with each other to effectively reduce the reflected light passing from the indicia plate toward the viewer.

It also provides the "pinhole" effect which makes it possible to achieve stringent contrast requirements that are associated with a certain applications of annunciators, such as in the cabins of certain aircraft. These requirements vary from application to application, but generally relate to the contrast between the energized brightness of the characters in the indicia plate 10 and the background brightness. Usually, the contrast requirement is represented as a decimal which is always less than unity. In addition, the brightness of the characters is usually specified for both the low voltage application and the high voltage application. These brightness requirements are typically expressed in units of foot-lamberts. Additionally, specific points within the indicia and around individual indicia characters are usually required to not exceed a specified brightness ratio. When the ratio of brightness at the higher voltage is extremely high in relation to the brightness at the lower voltage, achieving the specification requirements is virtually impossible within the constraint that is normally present that typical lamp reflectors increase by a ratio of approximately 28 to 1 when the voltage is increased from 2.2 volts to 5.0 volts. If the increase in brightness specified by the requirements is higher than this ratio when the two voltage requirements are compared, a significant change in the operating characteristic of the annunciator is required. The present invention provides this operating characteristic change by significantly increasing the efficiency of the light directing means. This increase in efficiency is achieved partially through the use of the light directing means 12 described above. Its shape, which comprises parabolic reflective surfaces 76, and the fact that these surfaces are painted with a reflective color, such as white, permits the light pipe or light directing means 12 to focus and scatter the light to provide improved light distribution in a direction generally perpendicular to a preselected plane. The present invention also provides the discs, such as represented by reference numerals 90 and 92, which are partially transmissive and partially reflective. Those discs are placed in the cavities, or openings 80 and 82, which serve as means for defining a light source position. The reflective disc 90 is disposed in front of the lamps, between the lamps and the front surface 50 of the light directing means 12. The transmittance of the disc attenuates the high brightness areas proximate the filaments of the lamps to a brightness that is generally equivalent to the surrounding brightness. The light which is reflected by the disc 90 is reflected back toward the parabolic surfaces of the light directing means 12. This light is then added to the overall brightness and uniformity of the total light being emitted by the light directing means 12 in a direction generally perpendicular to the preselected plane. The front surface 50 of the light directing means 12 is either a matte surface or a frosted surface. This surface treatment serves two purposes in a preferred embodiment of the present invention. First, it disperses the light leaving the light pipe in the intended direction to further improve the light distribution across the front surface 50. Another, and possibly more important, reason for the matte or frosted surface is to scatter external light passing inward toward the front surface 50. This phenomenon is illustrated in FIG. 4 by the arrow identified with reference numeral 190. As can be seen, a portion of the light passing entirely through the pinhole of the indicia plate 10 strikes the matte surface and is dispersed in numerous directions which permit absorption of the light. The scattering reduces the light component that would normally be reflected back through the openings in the indicia plate. By reducing this reflected light, the present invention also reduces the glow or brightness of the character when the lamps are de-energized. The brightness of the indicia or character in the indicia plate 10 is then able to blend with the brightness of the surrounding background provided by the darkened portions of the black legend layer and the black background layer, 154 and 170, in FIG. 6. The several improvements described above provide a significant improvement in the brightness/gain ratio when the annunciator changes from the low voltage operation to the high voltage operation.

With reference to FIGS. 1 and 4, it should be noted that the indicia plate 10 and the light directing means 12 could be bonded together with optically clear material to improve the light transmission and for contrast improvements. In addition, is should be understood that the light directing means 12, which comprises a solid body of plastic material, could me made of a material that is tinted to provide the desired display color.

With reference to FIG. 6, it should be noted that the matte front surface 160 of the present invention is used to disperse the incident light ray so that the reflected legend character images are not discernable when the lamps are de-energized. It also reduces the front surface reflection characteristics of the indicia plate. The "pinhole" effect results from the alignment of openings on both the front and back portions of the substrate 150. These aligned openings represent the alignment of numerals or characters, with the character on the back side of the substrate being slightly thicker or larger than the character on the front of the substrate in a most preferred embodiment of the present invention. However, it should be clearly understood that the character or symbol on the front and back surfaces could be identical in thickness and size within the scope of the present invention. The thicker character on the back surface of the substrate facilitates manufacturing and aides in the alignment process, but could also be achieved through more stringent manufacturing techniques in association with characters on the front and back surfaces of the substrate which are identical in every respect to each other. The pinhole effect resulting from this structure reduces the amount of light that can pass through the legend character openings into the internal lamp cavity of the light directing means 12. In other words, less light passing through the legend to the light directing means 12 will result in less light being reflected back through the characters from the light directing means toward the viewer. This reflected light would otherwise make the symbols appear as if the lamps were energized. The black screening on layers 154 and 162, in which the openings represent the indicia, align to form the pinhole. This forces any light, other than that which is nearly vertical to the preselected plane, to strike a light absorbing black surface. Only the light rays which are perfectly aligned with both openings will pass through the character into the lamp cavity to be reflected. By significantly reducing this reflected light, the "dead-front" or hidden legend is dramatically improved.

The blackened surfaces in layers 154 and 162 absorb a high percentage of light that is not aligned with the openings in their respective layers. The black front surface 154, by being disposed on the front, or viewing, surface of the substrate, provides an improvement in sharpness and distinctiveness of the characters. The neutral density layer 152, by being disposed on the front of the substrate, immediately lowers the transmission level of light entering the light system. By lowering the light intensity immediately, the light that can be reflected from the other surfaces is reduced. Then, all later reflected light from the light system is attenuated twice, once when the light passes through the character and a second time when it is reflected back through the character. This reduces the brightness of the character that would otherwise be caused by light reflected back toward the viewer after having been emitted from a source behind the viewer.

The thickness of the substrate 15 has been selected to improve the characteristics based on the location of the primary light source. In other words, if the angle that the majority of light entering the front "pinhole" is known, the thickness of the substrate can be determined as a function of this angle to insure that the rays from this angle will not pass through the opening on the back surface of the substrate but, instead, will strike the black surface 162 and be absorbed. The color layer 170 provides the desired color to be emitted by the indicia. This color layer 170 could be eliminated in the present invention if the color is added to the substrate or to the material of which the light directing means 12 is made. The white reflective layer 172 of the present invention is used to raise the overall brightness of the display. The white surface is used to reflect the light coming from the light pipe or light directing means 12, back into the light pipe to raise the overall efficiency of the lighting system. In other words, light emitted by the light directing means 12 which does not pass through the indicia openings is reflected back toward the light directing means and toward the parabolic reflective surface at the back portion of the light reflecting means for subsequent reflection perpendicular to the preselected plane described above.

Although the present invention has been described with significant specificity and has been illustrated to show a most preferred embodiment of the present invention, it should be understood that many other embodiments are within its scope.

The embodiments of the invention in which an exclusive property or right is claimed are defined as follows:

1. An annunciator, comprising:

means for defining a light source position;

means for directing light in a direction perpendicular to a generally flat surface, said directing means having a reflective surface, said light source position being disposed between said generally flat surface and said reflective surface, said reflective surface being curved; and means disposed between said light source position and said generally flat surface for partially reflecting light toward said reflective surface for partially transmitting light toward said generally flat surface, said light source position being disposed between said reflective surface and said generally flat surface.

2. The annunciator of claim 1, wherein:

said reflective surface is generally parabolic.

3. The annunciator of claim 1, further comprising:

a lamp disposed in said defining means at said light source position.

4. The annunciator of claim 1, further comprising:

a generally flat character plate disposed in parallel association with said preselected plane, said light source position being disposed between said character plate and said reflective surface.

5. The annunciator of claim 4, wherein:

said character plate comprises a generally transparent substrate, said substrate having a first surface disposed on a side of said substrate opposite to said light source position and a second surface disposed on a side of said substrate facing said light source position, said first surface being selectively darkened to define a first symbol.

6. The annunciator of claim 5, wherein:

said second surface being selectively darkened to define a second symbol.

7. The annunciator of claim 6, wherein:

said first and second symbols are generally identical.

8. The annunciator of claim 6, wherein:

said second symbol is an enlarged representation of said first symbol.

9. The annunciator of claim 6, further comprising:

a reflective layer disposed on said second side of said substrate.

10. The annunciator of claim 9, further comprising:

a color layer disposed between said reflective layer and said substrate

11. The annunciator of claim 10, further comprising:

a clear matte layer disposed on said first side of said substrate.

12. An annunciator, comprising:

a symbol plate, said symbol plate comprising a generally transparent substrate, said substrate having a first side and a second side;

a first legend layer disposed on said first side, said first legend layer defining a first symbol;

a second legend layer disposed on said second side, said second legend layer defining a second symbol, said first and second symbols being aligned with each other with said substrate disposed therebetween;

means for defining a light source position;

means for directing light in a direction perpendicular to a preselected plane, said preselected plane being generally parallel with said substrate, said directing means having a reflective surface, said light source position being disposed between said preselected plane and said reflective surface, said reflective surface being curved; and means disposed between said light source position and said preselected plane for partially reflecting light toward said reflecting surface and partially transmitting light toward said preselected plane.

13. The annunciator of claim 12, further comprising:

a reflective layer disposed on said second side of said substrate, said second legend layer being disposed between said substrate and said reflective layer.

14. The annunciator of claim 13, further comprising:

a color layer disposed between said second legend layer and said reflective layer.

15. The annunciator of claim 12, further comprising:

a neutral density layer disposed between said first legend layer and said substrate.

16. The annunciator of claim 15, further comprising:

a matte layer disposed on said first side of said substrate, said first legend layer being disposed between said matte layer and said first side of said substrate.

17. The annunciator of claim 12, wherein:

said directing means comprises a generally flat surface, said generally flat surface being parallel to said preselected plane, said light source position being disposed between said reflective surface and said generally flat surface.

18. The annunciator of claim 17, wherein:

said reflective surface is generally parabolic.

19. The annunciator of claim 12, further comprising:

a lamp disposed in said defining means at said light source position.

* * * * *

UNITED STATES PATENT AND TRADEMARK OFFICE

CERTIFICATE OF CORRECTION

PATENT NO. : 5,263,271

DATED : November 23, 1993

INVENTOR(S) : Ronald G. Cox, et al.

It is certified that error appears in the above-indentified patent and that said Letters Patent is hereby corrected as shown below:

On the title page, item (54) and column 1, delete "ANNUMCIATOR" and insert --ANNUNCIATOR--.

Signed and Sealed this

Twenty-eighth Day of June, 1994

Bruce Lehman

*Attest:*

BRUCE LEHMAN

*Attesting Officer*

*Commissioner of Patents and Trademarks*